United States Patent [19]

Eccleston

[11] Patent Number: 4,535,323

[45] Date of Patent: Aug. 13, 1985

[54] PREAMPLIFYING AND SIGNAL PROCESSING METHOD AND APPARATUS FOR THEFT DETECTION SYSTEMS

[75] Inventor: Larry Eccleston, Marshall, Mich.

[73] Assignee: Progressive Dynamics, Inc., Marshall, Mich.

[21] Appl. No.: 358,299

[22] Filed: Mar. 15, 1982

[51] Int. Cl.[3] ..... G08B 13/24

[52] U.S. Cl. ..... 340/572

[58] Field of Search ..... 340/572, 551, 552; 343/6.8 R, 6.8 LC

[56] References Cited

U.S. PATENT DOCUMENTS

| | | | |
|---|---|---|---|
| 3,790,945 | 2/1974 | Fearon | 340/572 |
| 4,168,496 | 9/1979 | Lichtblau | 340/572 |
| 4,300,183 | 11/1981 | Richardson | 340/572 |

FOREIGN PATENT DOCUMENTS

| | | | |
|---|---|---|---|
| 763681 | 5/1934 | France | 340/572 |

*Primary Examiner*—Jerry W. Myracle

*Attorney, Agent, or Firm*—Price, Heneveld, Huizenga & Cooper

[57] ABSTRACT

Improvements in theft-detection or surveillance systems of the type in which an alternating electromagnetic field is established across a doorway or other portal and is monitored to detect the presence within the field of a marker or tag member comprising a small strip of permalloy or like material of high permeability hidden or otherwise carried on merchandise or other articles and objects to thereby "mark" such merchandise or objects, i.e., to make them readily detectable even though hidden from view. More particularly regarded, the improvements in accordance herewith reside in signal-processing electronic circuitry which increases detection sensitivity and accuracy while at the same time reducing erroneous detection results. In particular, the circuitry utilizes summing and differencing techniques to improve signal-to-noise ratios and eliminate previously-unsuspected sources of error, and facilitates use of the concept of frequency spectrum-content ratios as a determinant in distinguishing between apparent detection of true markers from other objects or structures whose response to the alternating interrogation field closely resembles that of the true markers and would normally produce erroneous detection indications. Basically this is accomplished by using the aforementioned summing and differencing techniques to produce at least one summed signal resultant and one differenced signal resultant which have different frequency content spectrums, and subsequently processing such signal resultants by use of sampling techniques representative of both marker-presence and marker-absence, comparison of these samples through summing, differencing and peak-integrating techniques, as well as by other more particular approaches.

25 Claims, 4 Drawing Figures

PREAMPLIFYING AND SIGNAL PROCESSING METHOD AND APPARATUS FOR THEFT DETECTION SYSTEMS

TECHNICAL FIELD

This invention relates in a broad sense to detection systems and apparatus, and more particularly to detection systems principally used in "anti-pilfering", i.e., theft-prevention, systems; more particularly still, the invention relates to that type of detection system which an alternating electromagnetic field is monitored to unobtrusively and invisibly detect the presence within the field of a small strip of permalloy or like highly-magnetizable (very low coercivity) metal foil which is hidden upon or in articles such as consumer merchandise whose theft or otherwise-impermissible taking is to be detected and prevented.

BACKGROUND OF THE INVENTION

Many prior efforts have been made toward deterring or preventing thefts in the nature of shoplifting, or other undesired removal of "contraband" articles or goods, for example, unchecked library books or the like, and such prior efforts have given rise to a variety of different systems and approaches, based upon different technological phenomena including, for example, detection of permanent magnet pieces, a variety of electromagnetic field applications, microwave systems, infrared or ultraviolet, etc. These rather extensive prior efforts have, quite understandably, advanced the general state of the art in these different fields, and have in general enhanced the degree of success available; however, the desired end is exceedingly difficult from a technological point of view, since the areas to be monitored (in general, doorways or like points of egress) are large in a physical sense, whereas the articles under surveillance are usually relatively small, requiring a proportionally tiny detection element or "marker". Generally speaking, this requires exceedingly high system sensitivity, but it is not only important to detect the illicit passage of contraband material; it is almost equally as important to avoid "false alarms", in which bona fide customers or other innocent persons are wrongly pointed out as carrying stolen or contraband goods through the portal, since this not only leads to immediate wrongful embarrassment of the individual involved, but also is likely to cost the merchant or other proprietor the loss of substantial goodwill and, potentially, possible litigation by those claiming to be damaged by such incidents.

Accordingly, real progress satisfying both of the aforementioned requirements of high sensitivity attended by great selectivity has been difficult to achieve and slow in coming. This conclusion is evidenced by the issuance of various patents over a long period of years, each asserting the achievement of improvements, but each followed in time by another patent directed to still a further improvement in a seemingly continuous sequence. By way of example, perhaps the most frequently-employed, and probably the most successful system concept, relates back to the often-noted French Patent of P. A. Picard, No. 763,681, issued in 1934, in which the technological phenomenon is described as involving electromagnetic field perturbations resulting from the insertion or presence within the field of a piece of magnetic material. In particular, Picard noted the field effects created by the presence of highly-magnetic (high permeability) material such as permalloy, which creates the presence of a number of the higher-order odd harmonics of the fundamental frequency of the applied field (e.g., Picard referred to the presence of the ninth and eleventh harmonic). While a period of almost 50 years has elapsed since the appearance of this patent to Picard, various patents continue to issue from time to time asserting advances in Picard's theories and findings in the area of "pilferage detection" systems of the type noted hereinabove; for example, reference is made to a number of patents issued to Edward Fearon (including U.S. Pat. Nos. 3,631,442, 3,754,226, 3,790,945, 3,820,103, 3,820,104) and to Peterson (U.S. Pat. No. 3,747,086), Elder et al. (U.S. Pat. Nos. 3,665,449 and 3,765,007) as well as U.S. Pat. No. 3,983,552 to Bakeman. Indeed, a very recent such patent is that issued to Robert Richardson, U.S. Pat. No. 4,300,183, which is directed to and describes various attributes of the underlying concept relating back to Pircard.

As stated above, the seemingly continuous advance in the general state of the art, as evidenced by the aforementioned patents, has undoubtedly provided new insights and improvements in the general level of the art, but requirements of truly satisfactory detection systems are very severe and demanding, and the need therefore continues to exist, and in some ways becomes even more pronounced, for truly reliable systems which will unerringly detect relatively small "marker" elements or indicia, while at the same time being essentially immune to a practically endless number of widely-varying metal devices, objects, articles, and components, all of which cause perturbations in the magnetic interrogation field, with resulting detection-actuating results being inevitably present.

BRIEF SUMMARY OF THE INVENTION

The present invention provides new and highly significant improvements in electromagnetic field-type detection systems of the type noted above, which improvements substantially enhance both the sensitivity and the selectivity of such a system, pursuant to which hitherto-unappreciated detrimental effects such as field-perturbing metal structural components in the environment of the egress portal (e.g., field-perturbing ceiling grids overhead and/or field-perturbing reinforcing rods or mesh in structural concrete nearby, etc.) are substantially eliminated as error sources. The improved system provided hereby thus makes it possible to accurately, consistently, and reliably detect the presence of tiny markers or tags of magnetic material and reject, or not detect, the presence of other field-disrupting metal elements or components as, for example, keys, pocketknives, wristwatches, metal containers such as beverage cans or the like, baby strollers and shopping carts, and a host of other widely-differing apparatus and objects.

In accordance with the invention, a detection system and method is provided with greatly enhanced processing of the marker-detection signals, incorporating a summing and differencing procedure for substantially improved signal-to-noise ratios, in accordance with which a comparatively low frequency component band and a comparatively high frequency component band are separately determined, and utilized in a multiple-step comparative manner to dynamically control the detection alarm threshold. In this manner, a balancing of the frequency components or bands is utilized, to produce alarms only when the ratio of frequency bands is in the appropriate order representative of the actual marker indicia, thereby avoiding false alarms produced by prior systems in response to metal articles whose field-perturbation effects tend to mimic those of the authentic marker, even including those articles which produce similar frequency components but which are distinguishable by the relative amounts of different frequency bands, i.e., the ratio of the signal strength representative of different frequency component bands.

Further in accordance with the invention, the method and apparatus provided operates to additively, or constructively, sum representations of detection signals indicative of marker presence within the field, regardless of and continuously consistent with, field alternation phase changes and differences; additionally, the method and apparatus provides differences or subtracts signals representative of non-marker presence (i.e., noise) in order to accurately portray non-marker effects. In this manner, the marker-characterizing signals are comparatively analyzed by reference to the non-marker signals, thus substantially enhancing selectivity.

Somewhat more particularly, in accordance with the present invention, methods and apparatus are provided for selective preamplification and processing of electrical signals containing indicia representative of the presence of a particular marker member with an electromagnetic interrogation field, said signals being produced by at least one receiver means which monitors the interrogation field, said method and apparatus producing a first composite electrical signal for marker-presence analysis by summing said electrical signals produced by said first and second receivers, to thereby increase detection sensitivity, producing a second composite electrical signal for use in marker-presence analysis by differencing said electrical signals produced by said first and second receivers, to reduce common-mode noise or other undesired signal characteristics in that composite electrical signal, and examining representations of said first and second composite marker-presence signals with respect to one another to determine characteristics indicative of the presence of the marker within the field. With particular regard to preferred methods and apparatus for accomplishing such examinations of signals and determinations of marker presence, reference is made to my co-pending application Ser. No. 358,383, filed on even date herewith, incorporated herein by reference.

A number of additional improvements and advantages are provided in accordance herewith, as described in more detail hereinafter in conjunction with certain preferred embodiments of the invention as depicted in the attached drawings and specifically noted in conjunction therewith for a more meaningful disclosure.

DETAILED DESCRIPTION OF PREFERRED EMBODIMENTS

Figure 1:
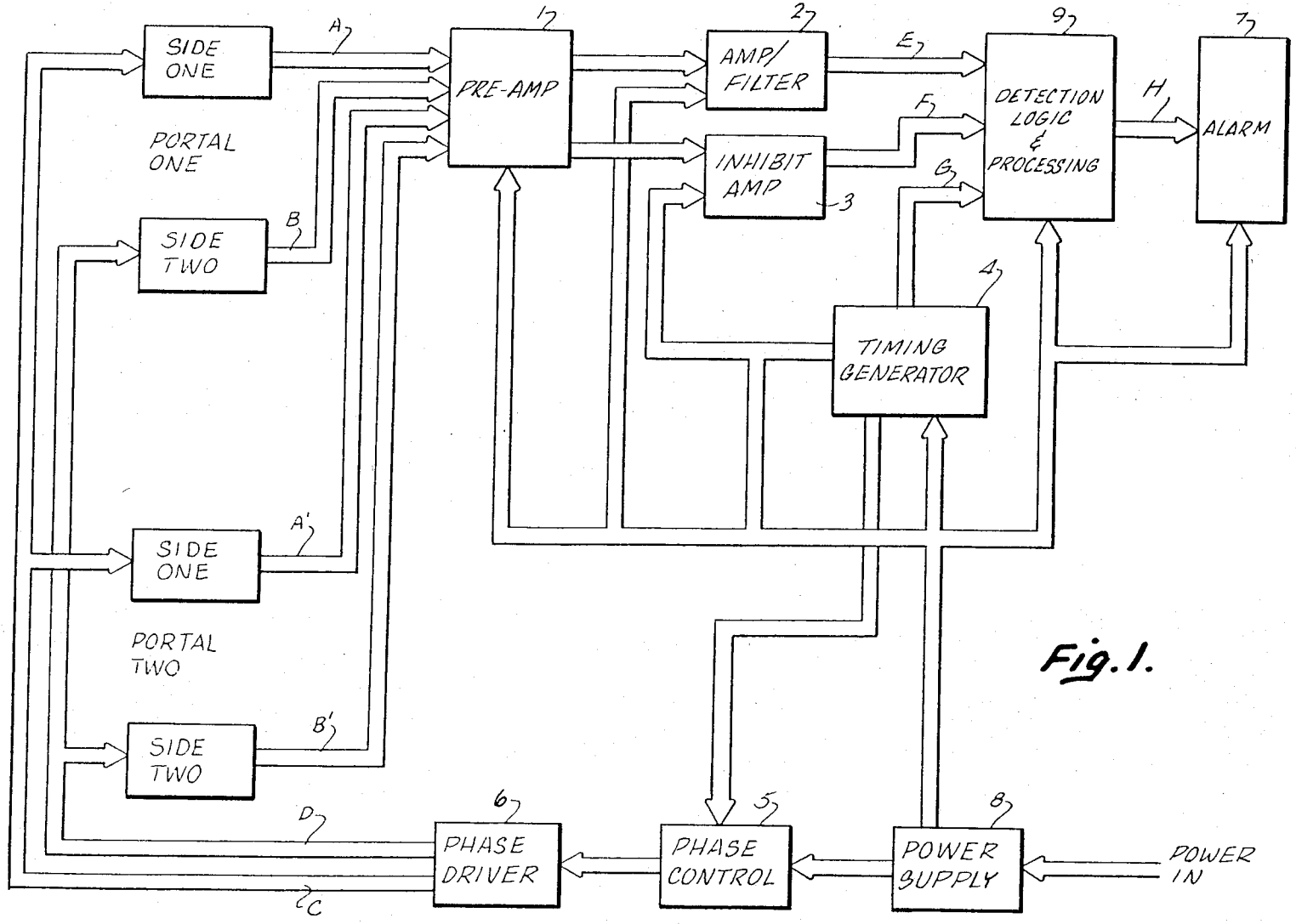
FIG. 1 is a simplified, schematic-form block diagram of the overall detection system in accordance with the invention.

The general nature of the overall system is illustrated in FIG. 1, in which a typical two-portal system is depicted. Generally speaking, such "portals" should be understood as being egress passages, e.g., doorways, on the opposite sides of each of which are maintained electromagnetic interrogation field sources (e.g., induction coils constituting part of an oscillating L-C circuit) together with a receiving antenna which monitors the electromagnetic field from that particular side of the portal. As will be understood, many of the prior patents referred to hereinabove depict and discuss systems using such interrogation coils and antennae; for example, Richardson Pat. No. 4,300,183 depicts a system and components whose general nature may be taken as more-or-less standard, dating back to the work of E. Fearon, whose prior patents are also noted above. As illustrated in the aforementioned Richardson patent, wherein the "portals" are designated "doorways", and wherein one of a number of different possible coil shapes and orientations are illustrated, the field-inducing coils are physically large, such that the interrogation field which they produce occupies a physical area which is more than sufficient for a human being to readily pass through. Inasmuch as the general characteristics, attributes, and parameters of such systems, including their field-inducing coils and receiving antennae, have long been known and have, in effect, resulted from the work of a number of individuals working at various points in time, the aforementioned prior patents of Fearon, Elder, Richardson, et al. should be considered as portraying the known state of the art and describing both general system characteristics and circuitry, componentry, and the like; consequently, these patents should, to the extent deemed necessary or desirable for environmental disclosure or otherwise, be considered as incorporated herein by reference. For a more detailed disclosure of preferred new interrogation field coil and portal configurations, reference is made to co-pending application Ser. No. 656,576, filed Sept. 17, 1984.

Referring further to FIG. 1 herein for a very general illustration of the overall system, it will be noted that "portal one" has a pair of oppositely-spaced sides, designated "side one" and "side two", and the same is true with respect to portal two, which may be considered a substantial duplicate of portal one. Each side one of each portal preferably receives the same type of drive, i.e., interrogation coil-excitation or drive current and each side two coil is also driven like its counterparts, although as explained hereinafter the side two excitation preferably changes in phase periodically whereas the side one excitation does not.

With continued reference to FIG. 1, it will be seen that the signal path from each side of each portal is individually coupled (via channels or paths A and A', and B and B') to a preamp 1, from which two outputs are separately processed, one being directed to an amplifier/filter 2 and the other to an inhibit amplifier 3, whose respective outputs are coupled on paths E and F to a detection logic and processing module 9, which also receives control signals on path G from a timing generator 4. Generally speaking, the detection logic module 9 functions to provide indicator and/or alarm signals indicative of the presence, within the alternating interrogation field maintained between the respective sides of a given portal, of the desired field-affecting marker member, such indicator or alarm outputs being depicted in FIG. 1 as coupled along a path H to an alarm module which is so marked. Power supply paths are indicated in FIG. 1 as being directed from an outside "power in" source to a power supply 8. The latter provides various power levels and types to the preamp 1, the detection logic module 9, the amp/filter 2, the inhibit amplifier 3, the timing generator 4, the phase driver control 5, and the phase driver 6. The outputs of the phase driver 6 are coupled along the aforementioned paths C and D to portals 1 and 2, to drive the oscillating interrogation coils located there. While state of the art circuits and components which are generally usable as the foregoing functional units are certainly known and available at the present point in time, and are referred to in the aforementioned prior patents, for example, certain preferred new versions or improvements of such are disclosed hereinafter and/or in various co-pending applications; for example, novel preferred detection logic and processing system and means are disclosed and claimed in the aforementioned co-pending application Ser. No. 358,383, filed on even date herewith, a novel preferred inhibit amplifier and processor are disclosed and claimed in co-pending application Ser. No. 364,264, filed April 1, 1982, and a preferred phase switching field coil driver and control are the subject of co-pending application Ser. No. 651,576, filed Sept. 17, 1984.

It should be understood that in accordance with the present invention the interrogation coils at the portals are preferably driven at a nominal oscillation frequency of 10 kHz, and that in order to maximize detection capabilities in a broad sense, it is desirable to drive the two interrogation coils on opposite sides of the same portal in an alternating in-phase and out-of-phase sequence, in "bursts" which continue over a desired number of cycles. Thus, for a first such period both sides of portal one (and also those of portal 2) will be driven together in phase, whereas for the next ensuing such period side one of each will be driven with the same phase as before but side two of each will be driven with directly out-of-phase excitation, the effect of which will be to re-direct the resultant direction of the interrogation field by 90°, thus affording detection capabilities for particular marker orientations within the field which might possible be missed or produce very weak detection signals if by chance oriented essentially orthogonal with respect to the direction of flux within the interrogation field. A particular example of a preferred phase-reversal sequencing comprises alternating bursts of 160 cycles (i.e., 16 msec) of the nominal 10 kHz fundamental alternation, separated by a "dead time" of "inter burst gap" of 4 msec, with the first such 160 cycle burst applied with the same phase condition (e.g., "phase A") on both sides one and two of each portal (i.e., "A-A" phasing), and the second such burst applied with "phase A" on side one and the opposite ("phase B") applied to side two of each portal (i.e., "A-B" phasing). Accordingly, the antenna at each portal side (constituting the initial "receiving means" herewith) will return in-phase signal components for marker-present conditions within the portal during the first such in-phase drive condition, and out-of-phase marker-present signals during the next such drive condition.

Figure 2:
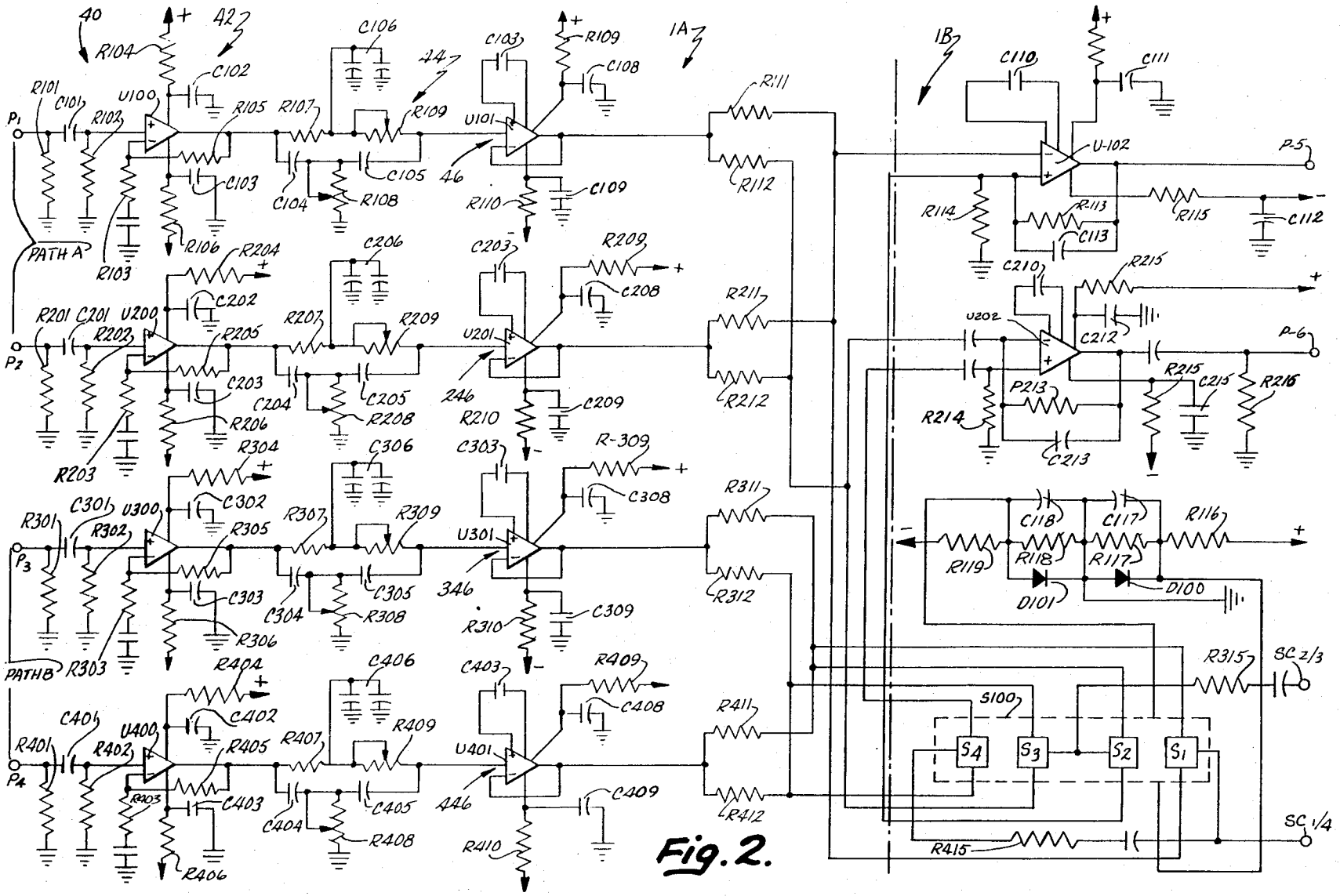
FIG. 2 is an enlarged and schematic circuit diagram of the preamplifier portion of the system shown in FIG. 1.
Figure 3:
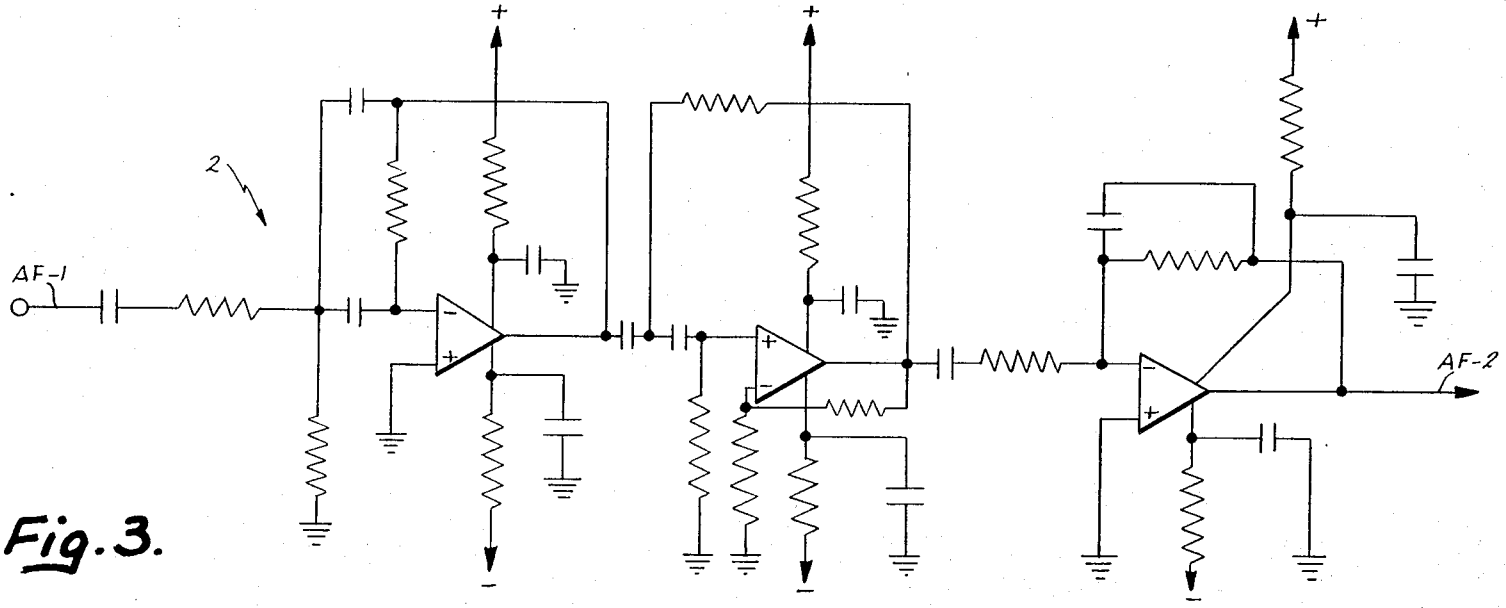
FIG. 3 is an enlarged schematic circuit diagram of the amplifier/filter portion of the system shown in FIG. 1.

As indicated in conjunction with FIG. 1, the detection signals from the antennae at the various portal sides are coupled along signal paths A, A′ and B, B′ to the preamplifier 1, a detailed illustration of a preferred embodiment of which is set forth in FIG. 2, to which reference is now made. In the preamp 1, signal paths A and A′ from the receivers, or antennae, which monitor side one of both portals one and two, are coupled respectively to preamp inputs P-1 and P-2. Conversely, signal paths B and B′ from side two of both portal one and portal two are coupled, respectively, to preamp inputs P-3 and P-4. As may be observed, each such preamp input feeds into an indentically-configured amplifying and filtering network branch, located generally within the circuit portion on the left, designated 1-A, and each of the four such preamplifier/filter network portions feeds into a summation circuit portion on the right, designated 1-B.

Generally speaking, the interrogation field-generating coils are driven, in the alternating-phase sequence noted above, with current pulses on the order of magnitude of approximately 50 amps, preferably once every several cycles of tank circuit oscillation (e.g., every fourth cycle of oscillaton), resulting in an oscillation of approximately three hundred volts (peak to peak) in amplitude. Each receiving antenna, therefore, would nominally detect a very strong 10 kHz signal, and for this reason the antennae are preferably figure-eighted in winding configuration, so as to null out as much as possible of the 10 kHz component. The field perturbations caused by the presence within one of the portals of the permalloy strip or other such marker element are miniscule in comparison to the tank drive level, thus presenting very substantial signal-processing difficulties in order to achieve high sensitivity, to avoid missing contraband-carried markers, while at the same time achieving a high degree of selectivity, to avoid erroneous contraband or theft-indicative alarms brought about by any of a variety of metallic objects or articles which also cause perturbations in the interrogation field.

Toward the foregoing end, certain characteristics of marker detection have become known which greatly facilitate the sensitivity-selectivity requirements; for example, the drive excitation pulses applied to the field-inducing coils are highly disruptive in and of themselves, and it is thus desirable to blank out all or part of the receiving circuitry during the time such drive pulses are being applied to the interrogation coil. Furthermore, the actual permalloy or other such low-coercivity markers create field perturbations by switching their magnetic domain orientation each half-cycle of alternation of the interrogation field, i.e., on each positive-going half-cycle as well as upon each negative-going half-cycle, with magnetic domain switching occurring during the first 90° of current flow in the coils for each such half-cycle. Accordingly, if the antenna ("receiver means") signals are examined to determine the presence of a marker within the field only during the current-rise portion of the cycle (i.e., the first 90°), other non-marker perturbations may be screened out. Furthermore, if a sample of the antenna/receiver means signals is examined during other portions of the cycles of interrogation field alternation, i.e., when marker perturbations are not anticipated (i.e., during the current-falling portion of each half-cycle), a representative ambient field condition may be established for comparison with the receiver means signals obtained or examined during those periods when marker signals are to be anticipated if indeed a marker is present within the portal, i.e., within the interrogation field.

In addition to the foregoing, the treatment afforded the receiver means signals prior to actual analysis efforts, whose purpose is to determine whether or not a marker is present, becomes very important to successful processing. That is, while it has heretofore been recognized that the interrogation field fundamental frequency (here, 10 kHz) must be eliminated to the fullest extent possible, the countervailing consideration is to maintain the integrity (fidelity) of the actual signal from the antenna to the greatest extent possible. This desired result is greatly facilitated by the circuit configuration shown in FIG. 2 for the preferred form of preamp 1, in which each separate preamp circuit branchs or channels proceeding from the different antenna inputs P-1, P-2, etc., is identical, thus making a description of only one such channel necessary. Referring to channel P-1, it may be seen that the signals first encounter a Pi-type RC filter 40, which applies an initial cut of 6 DB centered upon the 10 kHz drive frequency, but does not introduce any appreciable noise content as other filtering might. Next, the receiver signals encounter an amplifying stage 42, which is preferably a low-noise voltage amplifier having a gain in the order of about ten, designated U100. In a particular preferred embodiment, the latter is implemented by use of an integrated circuit operational amplifier such as that designated as IC5534 coupled into the circuit in the manner indicated, with resistive feedback. Accordingly, the receiver signals from the antennae esentially encounter strong low-noise amplification prior to operational filtering. Such filtering occurs after the first stage of amplification 42, in the twin-T notch filter 44 comprised of resistors R107, R108, R109, and capacitors C104, C105, and C106, in which it will be observed that resistors R108 and R109 are variable in nature, to provide for precise setting of the notch characteristics. Notch filter 44 is centered upon the 10 kHz interrogation field frequency, and supplies at least 40 DB of rejection for such frequency.

Following the notch filter 44 in the preamp circuit paths is a buffer stage of amplification 46, which may be implemented by another No. 5534 integrated circuit operational amp, configured to provide unity gain. It is to be noted that both amplifiers 42 and 46 should be wide band amplifiers, so as to accommodate all of the frequencies within the range extending from the fundamental of the interrogation field out to at least the fifteenth harmonic thereof, while set forth more fully hereinafter, it is to be noted that the high-order and low-order harmonic content of these antennae signals are utilized as important determinative factors in accordance herewith by observing the ratio or relative amounts of these bands of frequencies, at the lower band comprising primarily the third and fifth harmonic range, since this latter range is highly representative of interrogation field perturbations brought about by non-marker metal objects of many and different particular natures. That is, the actual permalloy or like marker produces a significantly different ratio of the higher-order harmonic band with respect to the lower-order harmonic band, even though both the authentic marker and other non-marker objects may produce varying amounts of both frequency bands in the responses detected from the field perturbations which they cause. Indeed, some particular and relatively unusual metal objects (such as certain plated keys and certain loop-form or mesh-type metal objects) may to a considerable degree "mimic" the response of an authentic permalloy or like marker, although in essentially every instance the actual ratio of the high order harmonic band to the low order band (as defined above) will be at least somewhat different than those brought about by the authentic marker element.

Each of the preamp circuit branches commencing at the inputs P-1, P-2, etc., thus produces a relatively noise-free and significantly amplified version of the antennae/receiver means signals, with the fundamental 10 kHz signal substantially reduced but with harmonics of this signal present. Each such circuit branch has a pair of output resistors R111/R112, R211/R212, etc., which are coupled into the summing portion 1-B of the preamp in the following manner. First, it will be noted that the R111/R211 outputs (i.e., "Path A") are ganged together and fed to the inverting side of a differential amplifier U102. This same ganged signal is coupled to the output side of an upper switch portion $S_1$ in a four-stage CMOS analog switch S100, through which signals from preamp branch P-3 and P-4 output resistors R311 and R411 may also be coupled, upon appropriate actuation (excitation) of switch control terminal $SC_{1/4}$, which also controls switch stage $S_4$ of the CMOS switch S100.

Output resistors R112 and R212 in preamp branches P-1 and P-2 are ganged together and coupled to the inverting input of a second differential amplifier U202, and that signal path is also coupled to the output side of a third switch stage $S_3$ of switch S100. Similarly, output resistors R312 and R412 of preamp branches P-3 and P-4 are ganged together and coupled to the input side of switch stage $S_3$ in switch S100. These same two output resistors, R312 and R412, are also coupled to the input of the fourth switch stage, $S_4$, of the CMOS switch S100, just as output resistors R311 and R411 are additionally commonly-coupled to the input side of the second switch stage, $S_2$, of switch S100.

From the foregoing, it may be seen that the output of commonly-coupled, preamp branches P-1 and P-2, which represent side one of both portals one and two (FIG. 1), are coupled to the inverting (i.e., "−") side of both differential amplifiers U102 and U202, and that signals from preamp branches P-3 and P-4, representing side two of both portals one and two (Path B in FIG. 1), will also be applied to this same side of differential amplifiers U102 and U202 (as outputs from resistors R311 and R411) when either the first stage ($S_1$) or the third stage ($S_3$) of switch S100 are actuated, through energization of their respective different control terminals (i.e., $SC_{1/4}$ or $SC_{2/3}$). At the same time, the non-inverting (i.e., "+") side of differential amplifier U102 is coupled to receive the outputs from side two of portals one and two (preamp branches P-3 and P-4, from resistors R311 and R411) whenever the second switch stage ($S_2$) of switch s100 is triggered by a signal on switch control terminal $SC_{2/3}$, and the analogous (non-inverting) side of differential amplifier U202 will receive the side two (branches p-3 and P-4) output signals (from resistors R312 and R412) upon actuation of the fourth stage ($S_4$) of switch S100, by an appropriate signal on switch terminal $SC_{1/4}$. For purposes of this specification, these control signals applied to switch terminals $SC_{1/4}$ and $SC_{2/3}$ may merely be considered as comprising appropriately-timed gating signals produced by the timing generator 4 of FIG. 1 which are closely synchronized to the oscillations of the L-C drive circuits for the interrogation field.

Accordingly, by supplying the aforementioned gating signals to the switch terminals of CMOS switch S100, the antenna signals from the opposite sides of the two portals will be constructively summed (magnitudes instantaneously added) in one path and conversely, "destructively summed" or differenced in another path, to provide two quite different but nonetheless related signal outputs on preamp output terminals P-5 and P-6, leading from differential amplifiers U102 and U202, respectively. More particularly, when both sides of each portal are being driven in-phase with one another, the outputs from their respectively-associated antennae are in phase and are directly added (summed) by operation of the first switch stage $S_1$ of switch S100, an appropriate control signal being suppled at that time to control terminal $SC_{1/4}$. Under these conditions, differential amplifier U102 has all four such amplified, in-phase antenna signals applied to its inverting input, and none applied to its non-inverting input. The control signal applied to terminal $SC_{1/4}$ also actuates the fourth switch stage, $S_4$, thus applying the very same output signal from channels P-3 and P-4 (Path B) to the second differential amplifier, U202, but in the reverse manner, i.e., applying such signals to the non-inverting input, whereas the other two antenna signals are applied to the inverting input, so that these two sets of signals are differenced, or subtracted, at differential amplifier U202.

When the opposite phase relationship occurs at the interrogation fields (i.e., side 2 of both portals driven out-of-phase with side 1 thereof), a similar end result is obtained through opposite switching of the analog switch S100. That is, additive summation occurs at differential amplifier U102 and subtractive summation at amplifier U202, i.e., signals from side two of both portals are arithmetically added together at amplifier U102 (directly out-of-phase signals applied to opposite inputs of the differential amplifier) while the same signals are arithmetically subtracted at amplifier U202 (i.e., directly out-of-phase signals resistively combined and applied to the inverting input, and no signal applied to the non-inverting input). Accordingly, the output appearing at preamp output terminal P-5 represents the algebraic difference but arithmetic sum, of the antenna signals from sides one and twp of the two portals, whereas the output at preamp terminal P-6 represents the algebraic summation but arithmetic difference of the antenna signals from opposite portal sides, taking into effect the alternating phase conditions present within the interrogation field. In this connection, it is to be noted that the control signals applied to terminals $SC_{1/4}$ and $SC_{2/3}$ and the CMOS switch S100 are preferably of sufficient duration to maintain switch actuation throughout the entire time interval from the initiation of one phase condition (for example, A-A) to the initiation of the next succeeding phase condition (continuing the example, A-B). That is, the "on" time for the switch should preferably continue through the aforementioned dead space or interburst gap, rather than ending at the immediate conclusion of the ongoing phase condition, since by continuing the summing and differencing operation on into the "dead space", additional signal information will be obtained with respect to interrogation field perturbations which will contribute meaningfully to system sensitivity and selectivity.

Quite clearly, the two signals appearing on preamp output terminals P-5 and P-6 will have substantially different characteristics, the first such output representing combined antenna outputs providing the highest possible signal-to-noise characteristics, for maximum sensitivity, whereas the output on the second such terminal has had eliminated from it "common-mode" noise and other such undesired frequency components. The first aspect is particularly important with respect to the weakest likely marker-present conditions, i.e., a marker whose particular metallurgy and/or physical characteristics produce very weak perturbations of the interrogation field, and which is located in the middle of the portal, midway between the two sides where the receiver means antennae are located, a set of conditions likely to be missed in prior systems. Of course, by use of a separate preamp circuit or path for each portal side receiver, i.e., antenna, sensitivity is optimized in any event, and even this basic factor has been lost upon certain of the prior systems; this is all the more true when the particular preamp circuit path configuration, as described above, is taken into consideration, since this optimizes the desired signal (i.e., harmonic frequency bands) with the least introduction of noise. Of course, the summing (additive and subtractive) described above is a further and very substantial enhancement for systems such as those in use or proposed heretofore.

Some of the reasons underlying the above-described differencing of the common-mode noise signals from the two different sides of a single portal result from the fact that, in contrast to the true or real (e.g., permalloy) marker, most other objects or materials which would have a low enough coercivity to generate harmonics of interest (i.e., tending to mimic or mask a true marker) also have low permeability and only cause a perturbation in the interrogation field when in close proximity to the portal sides, i.e., to an interrogation field-generating coil or to an antenna or receiver. Thus, a non-marker object carried through a portal causes a perturbation in the field as the object passes near the interrogation coil. At the same time, there are many objects or structures which may be present beneath the floor, for example, wire mesh, concrete reinforcing rods, etc., or in the ceiling (e.g., ceiling grids) which cause receiver signals in the 30 to 50 kHz region, i.e., the third and fifth harmonic of the 10 kHz drive frequency fundamental. Additionally, even distortion in the capacitor geometry and the coil geometry of the L-C field drive circuit are likely, due to the high magnetic flux densities, to produce receiver signals in the 30 to 50 kHz region. It is desirable to lower this background or ambient noise level, so that field perturbations caused by non-marker items passing through the portals very near the interrogation field coil at one side would have the greatest detectable effect, i.e., would be more easily and more reliably detected, and thus discriminated out of alarm-causing effect.

To this end, the receiver (antennae) signals from opposite sides of the same portal are "summed" (i.e., combined) in accordance herewith such that during each particular interrogation field phase condition such signals are arithmetically subtracted from one another, or differenced, that is, they will (at least partially) cancel out one another. The signals coming from the two antennae are much alike, and if the two signals, properly phased, are summed together so that one cancels with the other, the result will be to lower the signal portion attributable to "background" or environmental noise, thereby enhancing, or highlighting, pertubation effects from objects located near one portal side. On the other hand, a true marker causes a significant perturbation even as it passes down the center of a portal, and it is desirable to enhance those perturbation effects. To accomplish such enhancement, the antenna signals from opposite sides of the same portal are constructively (algebraically) added in the preamp and processor to produce a differently-constituted second composite or resultant signal for subsequent processing, containing all of the perturbation effects present at either antenna and therefore maximizing the result produced by a real marker.

Thus, the present invention provides an appreciation and realization that the only time a non-marker object is likely to produce perturbations with a harmonic response fairly closely mimicing that caused by an actual marker is when the object is close to one of the portal sides. That is, because of the comparatively low permeability of most non-marker objects, they do not have as large an affect on the interrogation field as the permalloy strip of a true marker does, and so only generate significant harmonics when interrogated with a very strong field. When so interrogated, a non-marker may actually generate some of the same harmonics as a marker, but not to the same extent, and not in the same ratio of harmonic orders, and non-marker objects will thus be detected to a greater extent when the object is close to one portal side. It is important to realize, moreover, that perturbations caused by non-markers do not have the same distribution or ratio of harmonics, and that is why it is desirable to produce, and compare, the two different preamp output signals, as done in accordance herewith. Furthermore, while a non-marker will theoretically produce the same distribution of harmonics, or the same harmonic content, whether it is in the middle of a portal or close to one side, the permeability of such an object is likely to be such that its magnetic domains do not even undergo switching by the interrogation field if the object is near the center of the field, whereas a true marker will still undergo substantial saturation and domain-switching under such circumstances. That is, the strength of the interrogation field does differ across its width, but the perturbation effect of any object is really a function of two factors: first, coercivity, which for non-markers is most likely not as low as that of the real marker, requiring a stronger field to cause domain-switching; second, non-marker objects do not have as high a permeability as real markers, and non-marker objects do not disrupt the field as much when they do undergo switching. Thus, there is a double effect as an object moves away from a side of the portal, and the effects caused by non-markers fade away very quickly.

The above-described separate outputs from preamp terminals P-5 and P-6 are separately and respectively applied to the amplifier/filter 2 and the inhibit amplifier 3 noted above in connection with FIG. 1, where each such output is separately processed (basically, amplified and frequency-shaped), and the resulting outputs are then separately supplied to the detection logic and processing unit 9.

Basically, the overall function and purpose of the detection logic and processing unit 9 is to produce an alarm signal or indication to show the presence of an authentic marker element within a portal, by appropriate processing of the output signals from the amplifier/filter 2 and the inhibit amplifier 3. For a detailed disclosure of a preferred embodiment of such detection logic and processing circuitry and processes, reference is here made to my aforementioned co-pending application Ser. No. 358,383, filed on even date herewith, and for a detailed disclosure of preferred inhibit amplifier circuitry and processes, reference is made to co-pending application Ser. No. 364,264, filed Apr. 4, 1982, both of which are incorporated herein by reference.

For purposes of general illustration and to help facilitate a thorough understanding of the present invention, it may be said that the inhibit amplifier 3 preferably comprises a band-pass amplifier whose pass band is centered upon the third and fifth harmonics of the fundamental frequency of oscillation of the interrogation field at the portal being monitored. The output from the inhibit amplifier is applied to an input of the detection logic unit 9, as indicated above and as shown in FIG. 1 (path F).

The output from the inhibit amplifier 3 comprises carefully-timed bursts of the frequency range representing primarily the third and fifth harmonic of the interrogation field fundamental, as noted above, and this output is applied to input terminal DL-4 of the detector logic circuit 9.

The second output from the preamp 1, namely that appearing on its output terminal P-5, is applied to the amplifier/filter 2, noted previously in connection with FIG. 1. Preferably, the amp/filter 2 is a three-stage band-pass device, having a single-ended output on its terminal AF2 which is directed to the detector logic circuit 9. With respect to the preferred characteristics of the amp/filter 2, the three stages of amplification may all be implemented by use of an LM-318 integrated circuit operational amplifier, connected in a multiple-pole amplifying configuration with appropriate frequency-shaping capacitance, centered upon the desired pass band comprising the fifteenth harmonic of the fundamental frequency at which the interrogation field is driven, in the embodiment contemplated here approximately 140 kHz. As already indicated, the output from terminal AF2 of the amplifier/filter unit 2 is directed to the detector logic network 9, where it is inputted on terminal DL-1.

Figure 4:
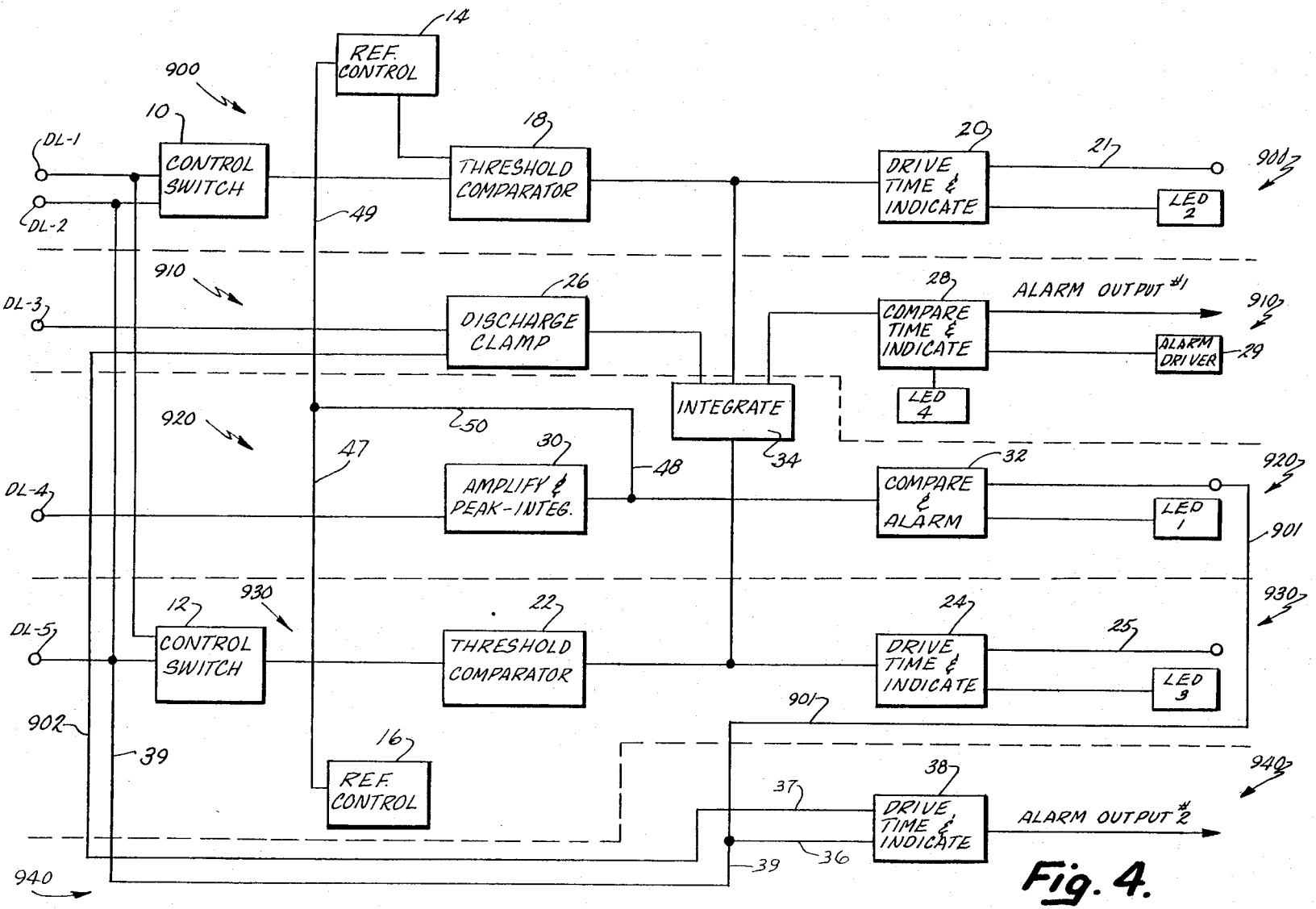
FIG. 4 is an enlarged, simplified system block diagram illustrating the preferred detection logic and processing circuitry.

FIG. 4 illustrates the general nature of a preferred form of the detection logic unit 9, in which it will be observed that this system has five discernible channels, designated by the numerals 900, 910, 920, 930, and 940, which are set apart from one another in this figure by dashed lines, for purposes of illustration. Of these, channels or sectors 900 and 930 are essentially the same as one another from the standpoint of componentry, although having very definite operational differences to be noted subsequently. That is, both channels 900 and 930 embody a control switch 10, 12, respectively, a reference control and threshold comparator set 14, 18 and 16, 22, respectively, and a driver, timer, and indicator unit or circuit portion 20 and 24, respectively, each of the latter having respective output terminals 21 and 25 as well as LED signal elements ("LED 2" and "LED 3", respectively). As further seen in FIG. 4, the respective outputs from the threshold comparators 18 and 22 are also directed to an integrator 34, and thus are seen to be summed with respect to one another; however, the particular manner in which such summing is carried out is an important aspect and is described in much greater detail, in the aforementioned co-pending application Ser. No. 358,383, filed which as noted above is incorporated herein by reference.

With continuing reference to the block diagram of FIG. 4, and to the general attributes of detector logic unit 9, the center channel portion 920 includes an amplifying and integrating detector 30, which receives an input from terminal DL-4, amplifies and peak-integrates the same, and provides an output which is applied to a comparator and alarm 32 having an LED indicator ("LED 1") as one of its outputs. The output from comparator and alarm 32 is also applied, by a conductor 901, as an input to the lower circuit channel 940, more particularly, to input terminal 36 of a driver, timer and alarm unit 38, which as indicated provides an "Alarm Output No. 2". Input terminal 36 of the alarm unit 38 also receives control signals on an input lead 39 connecting to the "signal gate" and "noise gate" inputs fed to control switches 10 and 12 from circuit input terminals DL-2 and DL-5. The second (upper) input terminal 37 of the driver, timer and alarm unit 38 is coupled back by conductor 902 to the input side of a discharge clamp 26 in path 910, whose primary input is from circuit terminal DL-3. The output of the discharge clamp 26 is coupled to, and directly affects, the integrator 34, and the integrator is coupled to, and actuates, a comparator, timer and alarm 28 having a primary alarm output directed to a lamp driver 29, which also provides a switched alarm output, labeled Alarm Output No. 1. Also, timer and alarm 28 controls an indicator LED ("LED 4") coupled to its output.

Perhaps the most important of the many important functions of the detection logic and processing network or unit 9 of FIG. 1 is carried out on circuit channel 920, shown in more detail in FIG. 4. As shown there, this circuit path receives an input on terminal DL-4, which input comprises the amplified, frequency-selective output from the inhibit amplifier 3, noted generally in connection with FIG. 1 and more particularly in the aforementioned co-pending application Ser. No. 364,264. This signal comprises sequential, time-gated, synchronized bursts of the subtracted (differenced) signals from the portal antennae, after low-pass selective amplification thereof in the inhibit amplifier 3. Consequently, this input is representative of the low-frequency component band (in the range of the third, fifth, and perhaps the seventh harmonics of the interrogation field, here on the order of 30 to 50, and approaching 70, kHz), which signal is attributable to an object within the interrogation field. Whether that object is an actual marker, or merely some non-marker element causing perturbations in the interrogation field, remains to be determined, but as already indicated, the true or actual markers will have a relatively unique ratio or balance of the high frequency component band with respect to the low frequency band. This low frequency band is used in the detection logic and processing unit 9 as a determinant which must be satisfied by the magnitude of the high frequency band produced by the same object within the interrogation field before a marker-present signal or alarm is sounded; i.e., the amount (magnitude) of the low frequency band actually encountered, as represented initially by the magnitude of the input applied to terminal DL-4, is used to determine the required level which the high frequency band produced by the same object in the field must equal or exceed if it is indeed an actual marker; the ratio or balance of these frequency components for true markers being relatively unique. Somewhat more particularly, as shown in FIG. 4, the output from the amplifying and peak-integrating detector 30 is fed, by conductors 48, 50, 47 and 49 respectively, to the reference controls 14 and 16, where it is applied as a controlling input whose effect is to vary, and continuously establish, the operative reference signal applied to the threshold comparators 18 and 22. For a more detailed disclosure of preferred methods and apparatus to achieve these results, reference is made to may previously-noted, co-pending application Ser. No. 358,383.

In accordance with the foregoing, and in accordance with the referenced and incorporated co-pending applications identified herein, it will now be appreciated that the present detection system provides a multiple-step or multi-layered approach for highly sensitive and yet highly selective detection of the low-coercivity permalloy or other such marker within the interrogation field, based upon the inevitably characteristic and relatively unique balance or ratio of low-order harmonics versus high-order harmonics caused by the magnetic domain-switching of the marker in response to each ensuing half-cycle of alternation of the interrogation field. Whereas many or even most metal objects will have some of the low-order harmonic band, and may even have an appreciable quantity of the high-order band, few if any non-marker objects will have the same characteristic ratio of high order to low order harmonic bands or component groupings; generally speaking, the relative content of the higher-frequency harmonic band will be deficient in objects and articles which are not true markers, even though, in a general sense, substantial quantities of the higher-order harmonics may indeed be present, particularly in objects and articles which provide multiple magnetic paths or loops and which include at least some arcing points, i.e., gaps in the magnetic circuits.

Thus, broadly speaking, the overall system of the invention provides a method and means to determine the low-frequency components or band and the high-frequency components or band of an object within the interrogation field, and to use these low-frequency components to dynamically control the detection threshold of the high-frequency components which produce an alarm signal. In so doing, and in accordance with the present invention, the signals from the antennae monitoring the interrogation field are carefully processed to produce two different types of signal output: one which represents the summation of the signals from the antennae, for maximum sensitivity (appearing on preamp output terminal P-5, and ultimately applied to detector/logic input DL-1 after amplification and shaping by the amp/filter 2), and the other of which represents the differencing of the signals from opposite sides of the interrogation field, for maximum selectivity (appearing on preamp output terminal P-6, and ultimately applied to detector/logic input DL-4 after amplification and shaping by the inhibit amp 3). These two signals are separately processed in the amp/filter 2 and inhibit amp 3, respectively, to emphasize their respective high- and low-order harmonic content, and the signal with the high-order harmonic band is time-sampled (by the switching signals applied to detector logic inputs DL-2 and DL-5, respectively) in a manner such that the resulting samples are likely to accurately portray marker-presence signals on the one hand and marker-absence or ambient-level (noise-level) signals on the other hand. The resulting samples are then separately and repeatly compared, by threshold comparators 18 and 24, to a varying threshold reference which is provided by a peak-integrated signal representative of the detected object's low-order harmonic band, such that the higher the level of the latter signal, the higher the level which the marker-present signal must have in order to bring about a threshold-crossing in either of the two marker-present or marker-absent signal channels.

Whatever threshold crossings do result from the foregoing process are then in effect differenced and the result integrated cumulatively by the main system integrator 34 over the repeated cycles of the interrogation frequency which occurs during each successive phase-related burst thereof. Should the resulting integrated level exceed that indicative of the presence of a genuine marker within the interrogation field, an alarm is sounded. Conversely, if the peak-integrated signal representative of the low-order harmonic band becomes sufficiently large to exceed a predetermined threshold, indicating that the variable reference to which the high-order frequency samples are compared has become prohibitively large and is, in effect, blocking the detection channels, an indication of that status is given (by alarm 32). Initially, this indication results from energizing an indicator light (LED 1) and, should the condition exist for a time period exceeding that attributable to some unusual but nonetheless expectable occurrence, a flashing alarm is enabled ("ALARM OUTPUT #2") (via detector logic channel 940).

The condition just described, indicative of an unusual and undesirable situation prevalent within the interrogation field which is causing a substantial overbalancing of the detection circuitry by way of excessive levels of the low-frequency harmonic band, is a severe aberration in the detection circuit parameters, and thus indicates the advisability of fully inhibiting the detection circuitry, in addition to the flashing lamp indication just noted which shows the existence of the condition. Thus, the signal indicative of the low-frequency overbalance which is coupled back to channel 940 for the purpose of enabling and driving the flashing lamp indicator is also coupled back, on conductor 39, to each of the control switches 10 and 12, such that they latch out and block the input from terminal DL-1, thereby preventing any build-up on integrator 34 which might otherwise result in an erroneous detection alarm.

Of course, it is to be understood that the above is merely a description of certain preferred embodiments of the invention, and that various changes and alterations can be made without departing from the underlying concepts and broader aspects of the invention as set forth in the appended claims, which are to be interpreted in accordance with such underlying concepts and broader aspects, and by application of a full range of equivalents.

The embodiments of the invention in which an exclusive property or privilege is claimed are defined as follows:

1. In a method of detecting the presence of a particular marker member within an electromagnetic interrogation field established between a pair of mutually spaced portal side members, wherein said electromagnetic field is made to alternate at one or more nominal frequencies and the field is monitored by at least first and second receiver means each disposed to access the field from a different side position at said portal to detect the presence of signal indicia introduced by such a marker in response to its exposure to the alternations of the field, and wherein said receivers each produce an electrical signal representative of the frequency content of the alternating field at least in the area of proximity nearer to that receiver, the improvement for use in detecting said marker which comprises the steps of: producing a first composite electrical signal for marker-presence analysis by summing representations of the said electrical signals produced by said first and second receivers, to thereby increase detection sensitivity; and producing a second composite electrical signal for use in marker-presence analysis by differencing representations of the said electrical signals produced by said first and second receivers, to reduce common-mode noise or other undesired signal characteristics in that composite electrical signal.

2. The improvement for a marker-detection method as recited in claim 1, including the steps of periodically changing at least certain of the alternation characteristics of said interrogation field in a manner which provides at least a brief interval between one such alternation characteristic and the next ensuing changed alternation characteristic; and continuing at least one of said summing and differencing during at least a portion of said brief interval.

3. The improvement for a marker-detection method as recited in claim 2, wherein said step of periodically changing at least certain of the alternation characteristics of said interrogation field comprises periodically changing certain phase characteristics of an electrical excitation current applied to a field-inducing coil means, and said brief interval comprises a "dead time" between applications of said excitation current, and wherein at least one of said summing and differencing is continued substantially through the duration of said brief interval.

4. The improvement for a marker-detection method as recited in claim 1, including the steps of periodically changing certain phase characteristics of an electrical excitation current applied to a field-including coil means, and carrying out at least one of said summing and differencing before and after said periodic changes in phase characteristics by applying signals produced by said receivers to a summing means in synchronism with said changes in phase characteristics, such that in-phase signals are added to effect summing in a first condition of said phase characteristics and out-of-phase signals are subtracted to effect summing in a second condition of said phase characteristics.

5. In a method of detecting the presence of a particular marker member within an electromagnetic interrogation field established between a pair of mutually-spaced portal side members, wherein said electromagnetic field is made to alternate at one or more nominal frequencies and the field is monitored by at least first and second receiver means each disposed to access the field from a different side position of said portal to detect the presence of signal indicia introduced by such a marker in response to its exposure to the alternations of the field, and wherein said receivers each produce an electrical signal representative of the frequency content of the alternating field at least in the area of proximity nearer to that receiver, the improvement for use in detecting said marker which comprises the steps of: differencing representations of the said electrical signals produced by said first and second receivers to produce a resulting composite electrical signal having reduced ambient noise signal characteristics, and subsequently using said resulting composite electrical signal in analysis of certain of said receiver-produced signals to determine the presence of such a marker within said field.

6. Apparatus for detecting the presence of a particular marker member within an alternating electromagnetic interrogation field established between a pair of mutually spaced portal side members and having at least one nominal frequency of alternation, comprising in combination: first and second receiver means each disposed to access the field from a different side position of said portal and adapted to detect the presence of such a marker within said field by producing an electrical signal representative of the frequency content of the alternating field at least in the area of proximity nearer to that respective receiver; means for producing a first composite electrical signal for marker-presence analysis by summing representations of the said electrical signals produced by said first and second receivers, and for producing a second composite electrical signal for use in marker-presence analysis by differencing representations of the said electrical signals produced by said first and second receivers.

7. The apparatus for marker detection as recited in claim 6, wherein at least certain of the alternation characteristics of said interrogation field are periodically changed in a manner which provides at least a brief interval between one such alternation characteristic and the next ensuing changed alternation characteristic, and further comprising means for continuing at least one of said summing and differencing during at least a portion of said brief interval.

8. The apparatus for marker detection as recited in claim 7, wherein said alternation characteristics of said interrogation field are periodically changed by changing certain phase characteristics of an electrical excitation current applied to a field-inducing coil means, and further including means for controlling said summing and differencing before and after said periodic changes in field phase characteristics in response to switching signals from said receivers, and including means for applying said switching signals to said means for controlling summing and differencing in synchronism with said changes in field phase characteristics, such that in-phase receiver signals are added to effect summing in a first condition of said phase characteristics and out-of-phase receiver signals are subtracted to effect summing in a second condition of said phase characteristics.

9. In an apparatus for detecting the presence of a particular marker member within an alternating electromagnetic interrogation field established between a pair of mutually spaced portal side members, wherein said electromagnetic field is monitored by at least first and second receiver means each disposed to access the field from a different side position of said portal to detect the presence of signal indicia introduced by such a marker in response to its exposure to the alternations of the field, said receivers each producing an electrical signal representative of the frequency content of the alternating field at least in the area of proximity nearer to that receiver, the improvement comprising: means for differencing the said electrical signals produced by said first and second receivers to produce a resulting composite electrical signal having reduced ambient noise signal charcteristics, and means for subsequently using said resulting composite electrical signal in analysis of certain of said receiver-produced signals to determine the presence of such a marker within said field.

10. Apparatus for detecting the presence of a particular marker member within an alternating electromagnetic interrogation field established between a pair of mutually spaced portal side members and having at least a first nominal frequency of alternation, comprising in combination: first and second receiver means each disposed to monitor said field from different positions on the spaced sides of said portal to detect the presence of signal indicia introduced by such a marker in response to its exposure to the alternations of the field, said receivers each adapted to produce an electrical signal representative of the frequency content of the alternating field at least in the area of proximity nearer to that receiver; means for combining representations of the electrical signals produced by said first receiver with representations of the electrical signals produced by said second receiver so as to produce differently-constituted first and second analysis signals in a manner such that the first such analysis signal primarily indicates the higher-order frequencies constituting said signals introduced by said marker and the second such analysis signal primarily includes the lower-order marker-introduced frequencies.

11. Apparatus for determining the presence of a predetermined marker member within an alternating electromagnetic interrogation field as recited in claim 10, further comprising: preamplifier and processor means for receiving said monitor-produced electrical signals; said preamplifier and processor means having a separate signal path for separately carrying the signals produced by each different monitor; each of said separate signal paths having an amplifying stage preceding a filter stage, said filter stage being tuned to reject the fundamental frequency of alternation of said interrogation field; and summation circuit means following said filter stages for selectively combining at least portions of the amplified and filtered signals from said separate signal paths to produce processed signal sequences for marker-presence analysis.

12. The improvement recited in claim 11, wherein said filter stage comprises a notch filter.

13. The improvement recited in claim 11, wherein said separate signal paths include at least one additional amplifier stage following said filter stage.

14. The improvement recited in claim 11, wherein said summation circuit means for combining predetermined characteristics of the amplified and filtered signals include means for additive and subtractive summing of at least portions of said signals.

15. The improvement recited in claim 14, wherein said means for summing includes selectivity controllable switch means for directing signals from selected different ones of said signal paths to commonly-shaped circuit components where summing of such signals takes place.

16. The improvement recited in claim 15, wherein said means for summing includes differential amplifier means having inputs coupled to receive said switched selected signals.

17. The improvement recited in claim 15, wherein said selectively controllable switch means includes a control input terminal coupled to receive a signal which is representative of certain of the alternation characteristics of said interrogation field.

18. The improvement recited in claim 17, wherein said control input terminal of said switching means is coupled to receive a signal which is representative of the phase characteristics of the alternations of said interrogation field, such that said switching means effects predetermined phase-related summing of said monitor means signals.

19. The improvement recited in claim 18, wherein said switching means comprises an analog switching component.

20. The improvement recited in claim 18, wherein said means for summing includes differential amplifier means having inputs coupled to receive said switched selected signals.

21. The improvement recited in claim 20, wherein said filter stage comprises a notch filter.

22. The improvement recited in claim 21, wherein said notch filter includes at least one variable resistance element.

23. The improvement recited in claim 21, wherein said separate signal paths include at least one additional amplifier stage following said filter stage.

24. The improvement recited in claim 23, wherein said switching means comprises an analog switching component.

25. In a method for determining the presence of a predetermined marker member within an alternating electromagnetic interrogation field, of the type using a plurality of monitors which produce electrical signals containing indicia indicative of the presence of such a marker within such field, the improvement comprising: subjecting the signals from different particular ones of said plurality of monitor means to preamplification and subtractive processing before signal analysis which determines and indicates marker presence or absence, said preamplification comprising the separate application of the signals from different monitor means to separate preamplification channels, and said subtractive processing comprising subtracting a monitor means signal produced by a monitor means relatively further from a marker within the interrogation field from a different marker means signal produced by a monitor means which is relatively closer to that marker, thereby balancing the said further and closer monitor means signals with respect to one another and at least partially cancelling out ambient noise and/or other undesirable effects from the monitor means signals prior to further processing thereof.

* * * * *

UNITED STATES PATENT AND TRADEMARK OFFICE

CERTIFICATE OF CORRECTION

PATENT NO. : 4,535,323

DATED : August 13, 1985

INVENTOR(S) : Larry Eccleston

It is certified that error appears in the above-identified patent and that said Letters Patent is hereby corrected as shown below:

Column 2, line 18:
"Pircard" should be --Picard--

Column 4, line 42:
"656,576" should be --651,576--

Column 5, line 47:
"possible" should be --possibly--

Column 5, line 53:
"of" should be --or--

Column 6, line 10:
"indentically-configured" should be --identically-configured--

Column 6, line 21:
"oscillaton" should be --oscillation--

Column 7, line 13:
"branchs" should be --branch,--

Column 7, line 13:
"channels" should be --channel--

Column 7, line 29:
"esentially" should be --essentially--

UNITED STATES PATENT AND TRADEMARK OFFICE

CERTIFICATE OF CORRECTION

PATENT NO. : 4,535,323

DATED : August 13, 1985

INVENTOR(S) : Larry Eccleston

It is certified that error appears in the above-identified patent and that said Letters Patent is hereby corrected as shown below:

Column 8, line 40:
"(Fig. 1)" should be --(Path A, Fig. 1)--

Column 8, line 54:
"s100" should be --S100--

Column 8, line 57:
"p-3" should be --P-3--

Column 9, line 43:
"twp" should be --two--

Column 12, line 63:
after "Ser. No. 358,383," delete "filed"

Column 14, line 3:
"may" should be --my--

Column 14, line 62:
"repeatly" should be --repeatedly--

Column 16, line 33:
"field-including" should be --field-inducing--

Column 17, line 57:
"charcteristics" should be --characteristics--

UNITED STATES PATENT AND TRADEMARK OFFICE

CERTIFICATE OF CORRECTION

PATENT NO. : 4,535,323

DATED : August 13, 1985

INVENTOR(S) : Larry Eccleston

It is certified that error appears in the above-identified patent and that said Letters Patent is hereby corrected as shown below:

Column 18, lines 11 and 12:
"indicates" should be --includes--

Column 18, line 45:
"commonly-shaped" should be --commonly-shared--

Column 20, line 16:
"undesirable" should be --undesired--

Signed and Sealed this

*Twenty-second* Day of *April 1986*

[SEAL]

*Attest:*

DONALD J. QUIGG

*Attesting Officer*

*Commissioner of Patents and Trademarks*